US006148871A

United States Patent [19]

Hassell et al.

[11] Patent Number: 6,148,871

[45] **Date of Patent: *Nov. 21, 2000**

[54] WOVEN FABRIC WITH FLAT FILM WARP YARNS

[75] Inventors: Stephen Michael Hassell, Charlotte, N.C.; Harold Francis Weber, Rock Hill, S.C.; Ronald Leefate Dunn, Fort Mill, S.C.; Stevenson Christopher Freeman, Rock Hill, S.C.; Ray Austin Wood, Fort Mill, S.C.

[73] Assignee: Spring Industries, Inc., Fort Mill, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/184,487

[22] Filed: Nov. 2, 1998

[51] Int. Cl.[7] ..... D03D 15/00

[52] U.S. Cl. ..... 139/420 A; 139/426 R; 246/103

[58] Field of Search ..... 264/103; 139/426 R, 139/420 A

[56] References Cited

U.S. PATENT DOCUMENTS

| | | | |
|---|---|---|---|
| 2,533,996 | 12/1950 | Clarkson | 164/65 |
| 2,740,443 | 4/1956 | Brown | 146/168 |
| 3,110,905 | 11/1963 | Rhodes | 139/391 |
| 3,283,788 | 11/1966 | Bottomley et al. | 139/28 |
| 3,317,366 | 5/1967 | Dionne | 161/66 |
| 3,327,468 | 6/1967 | Page | 57/140 |
| 3,336,645 | 8/1967 | Mirsky | 28/1 |
| 3,398,220 | 8/1968 | Port et al. | 264/147 |
| 3,503,106 | 3/1970 | Port et al. | 28/72 |
| 3,604,474 | 9/1971 | Kamei | 139/420 |
| 3,611,699 | 10/1971 | Wininger et al. | 57/140 |
| 3,626,989 | 12/1971 | Held | 139/11 |
| 3,712,344 | 1/1973 | Kovacec | 139/11 |
| 3,789,469 | 2/1974 | Kodama | 28/72.6 |
| 3,918,135 | 11/1975 | Kim | 28/72 |
| 3,971,279 | 7/1976 | Wright | 83/425.4 |
| 4,107,371 | 8/1978 | Dean | 428/255 |
| 4,107,827 | 8/1978 | Sasshofer et al. | 28/246 |
| 4,118,842 | 10/1978 | Norris et al. | 28/218 |
| 4,120,223 | 10/1978 | Bosse | 83/425.3 |
| 4,137,614 | 2/1979 | Wolstencroft | 28/172 |

(List continued on next page.)

FOREIGN PATENT DOCUMENTS

| | | | |
|---|---|---|---|
| 0 340 992 | 11/1989 | European Pat. Off. | D05C 17/02 |
| 2 259 926 | 8/1975 | France | D03D 15/00 |
| 2657506 | 6/1978 | Germany | 83/425.3 |
| 31 37 825 | 5/1982 | Germany | D03D 1/00 |
| 47-28625 | 6/1978 | Japan | 83/425.3 |
| 63-092750 | 4/1988 | Japan . | |
| 2739302 | 4/1998 | Japan . | |
| 6 801 496 | 11/1968 | Netherlands . | |
| 1236011 | 6/1971 | United Kingdom | D01D 5/00 |

OTHER PUBLICATIONS

Rule 132 Declaration of Stephen Michael Hassell

*Primary Examiner*—Andy Falik
*Attorney, Agent, or Firm*—Myers Bigel Sibley & Sajovec

[57] ABSTRACT

A textile fabric comprises a plurality of weft yarns extending generally in a weft direction and a plurality of flat film warp yarns extending generally in a warp direction. The warp yarns are interwoven with the weft yarns in a series of identical repeating units of a predetermined weave pattern. The flat film warp yarns, which are preferably between about 10 and 40 $\mu$m in thickness and 0.010 and 0.025 inches in width, are preferably interwoven with the weft yarns such that, in each of the identical repeating units, the weft yarns are interwoven as coupled pairs, such that a first yarn of each of the coupled pairs follows the same interweaving pattern relative to each of the flat film warp yarns as a second yarn of that pair. This configuration, known as a "double-pick" configuration, can produce a fabric that has acceptable appearance and feel, but at a considerably lower cost than typical textile fabrics of comparable weight because of the presence of the flat film warp yarns. The flat film warp yarns can be formed on a slitting apparatus having a plurality of parallel, aligned, spaced apart cutting blades.

21 Claims, 6 Drawing Sheets

U.S. PATENT DOCUMENTS

| | | | |
|---|---|---|---|
| 4,384,018 | 5/1983 | Caswell et al. . | |
| 4,422,359 | 12/1983 | Leboeuf | 83/546 |
| 4,466,163 | 8/1984 | Long et al. | 28/170 |
| 4,674,380 | 6/1987 | Hecht et al. | 83/425.2 |
| 4,819,528 | 4/1989 | Chadwick | 83/13 |
| 4,947,897 | 8/1990 | Binnersley et al. | 139/445 |
| 5,054,524 | 10/1991 | Kato et al. | 139/383 |
| 5,121,885 | 6/1992 | Chipman | 242/56.4 |
| 5,902,658 | 5/1999 | Wyman | 428/40.1 |

WOVEN FABRIC WITH FLAT FILM WARP YARNS

FIELD OF THE INVENTION

The present invention relates generally to textiles and apparatus for producing textiles, and relates more specifically to textiles woven from threads formed from film sheets and apparatus for producing such fabrics.

BACKGROUND OF THE INVENTION

Fabrics used as functional decorative coverings, such as bedding, upholstery and window treatments, are typically woven fabrics comprising yarns of cotton, polyester, or cotton polyester blends. The materials are chosen based on the need for such fabrics to be attractive in appearance and texture, durable, stain resistant, and printable. Many factors can influence the ultimate properties of the fabric; these can include the material from which the yarns are formed, the weight of the yarns, the configuration of the yarns (e.g., multifilament, spun, cabled, etc.), and the weave density.

Of these factors, thread count can be particularly important. For example, a "percale" fabric (regarded in the industry as a highly desirable fabric for sheets and other bedding) typically has a thread count of at least 180 yarns per square inch. At such a thread count, fabrics tend to be quite soft, strong and relatively opaque, thereby providing a highly desirable fabric.

Unfortunately, the additional yarns employed to provide a fabric with high thread counts typically drive up the cost of the fabric proportionately. The higher cost is dependent on both the cost of the additional yarns and the need for more loom motions for each inch of fabric produced. As such, many manufacturers produce fabrics with lower thread counts (such as about 120 yarns per square inch) that are less expensive than percale fabrics but have a less luxurious feel.

Because consumers are willing to pay less for these lower cost fabrics, the expense of the additional yarns can be problematic for the manufacturer. Much of the cost of the yarn lies in the production process used to form the yarns rather than in the raw material itself. Most of the yarns employed in these fabrics are spun yarns formed of cotton, polyester, or cotton polyester blends. The processing of spun yarns typically includes carding, drawing, spinning, warping and slashing steps that are performed prior to the yarn being ready for weaving; for ring spun yarns, additional roving and winding steps are also required. The inclusion of these numerous processing steps increases the production cost of the yarns significantly. However, simply omitting yarns from these fabrics (which, of course, already have lower thread counts than the percale fabrics discussed above) in the interest of saving money often results in an unacceptable product. Reducing thread count while keeping yarn sizes constant can result in loose, open constructions that allow light to pass through, battings to show through, or even fibers to percolate out. This can be important for pillows, bedsheets and comforters.

SUMMARY OF THE INVENTION

In view of the foregoing, it is an object of the present invention to provide a fabric suitable for use in bedding, upholstery, window treatments, and the like with reduced cost while maintaining or improving fabric appearance and properties.

It is also an object of the present invention to provide such a fabric that utilizes yarns with reduced processing demands prior to weaving.

It is an additional object of the present invention to provide an apparatus that assists in the production of such a fabric.

These and other objects are satisfied by the present invention, which is directed to a textile fabric that utilizes flat polymeric film warp yarns. The textile fabric of the present invention comprises a plurality of weft yarns extending generally in a weft direction and a plurality of flat film warp yarns extending generally in a warp direction. The warp yarns are interwoven with the weft yarns in a series of identical repeating units of a predetermined weave pattern. The flat film warp yarns, which are preferably between about 10 and 40 $\mu$m in thickness and 0.010 and 0.025 inches in width, are preferably interwoven with the weft yarns such that, in each of the identical repeating units, the weft yarns are interwoven as coupled pairs, such that a first yarn of each of the coupled pairs follows the same interweaving pattern relative to each of the flat film warp yarns as a second yarn of that pair. This configuration, known as a "double-pick" configuration, can produce a fabric that has acceptable appearance and feel through enhanced cover factor, but at a considerably lower cost than typical textile fabrics of comparable weight because of the presence of the flat film warp yarns.

The flat film warp yarns can be produced with a slitting apparatus of the present invention, which comprises: a support frame; a plurality of substantially planar cutting blades, each of which includes opposed cutting edges and opposed ends; a mounting structure for mounting the cutting blades to the support frame; and a feed roll attached to the support frame and configured to feed film in a downstream direction over the exposed cutting edges of the blades. The mounting structure is configured to mount the cutting blades in substantially aligned, parallel and spaced apart relationship, wherein the blades are mounted such that each blade has one of its cutting edges exposed for cutting, and wherein the cutting edges of adjacent blades are spaced apart from each other between about 0.010 inches and 0.025 inches.

Preferably, the blades are mounted in a blade cartridge, in which the blades are separated by spacers, each of which is recessed from the cutting edges to enable the film to be cut. The spacers and blades are mounted within a blade receiving compartment with one cutting edge of each blade exposed. It is preferred that both the blades and spacers have two planes of symmetry such that the cutting edges and ends thereof are substantially identical. This configuration can enable the cutting blades to be reoriented into one of four orientations within the cartridge and still be used for cutting, thereby enabling either cutting edges to be used irrespective of which end of the cutting blade extends in the downstream direction.

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like components throughout, and dimensions of components and layers may be exaggerated for clarity.

Figure 1:
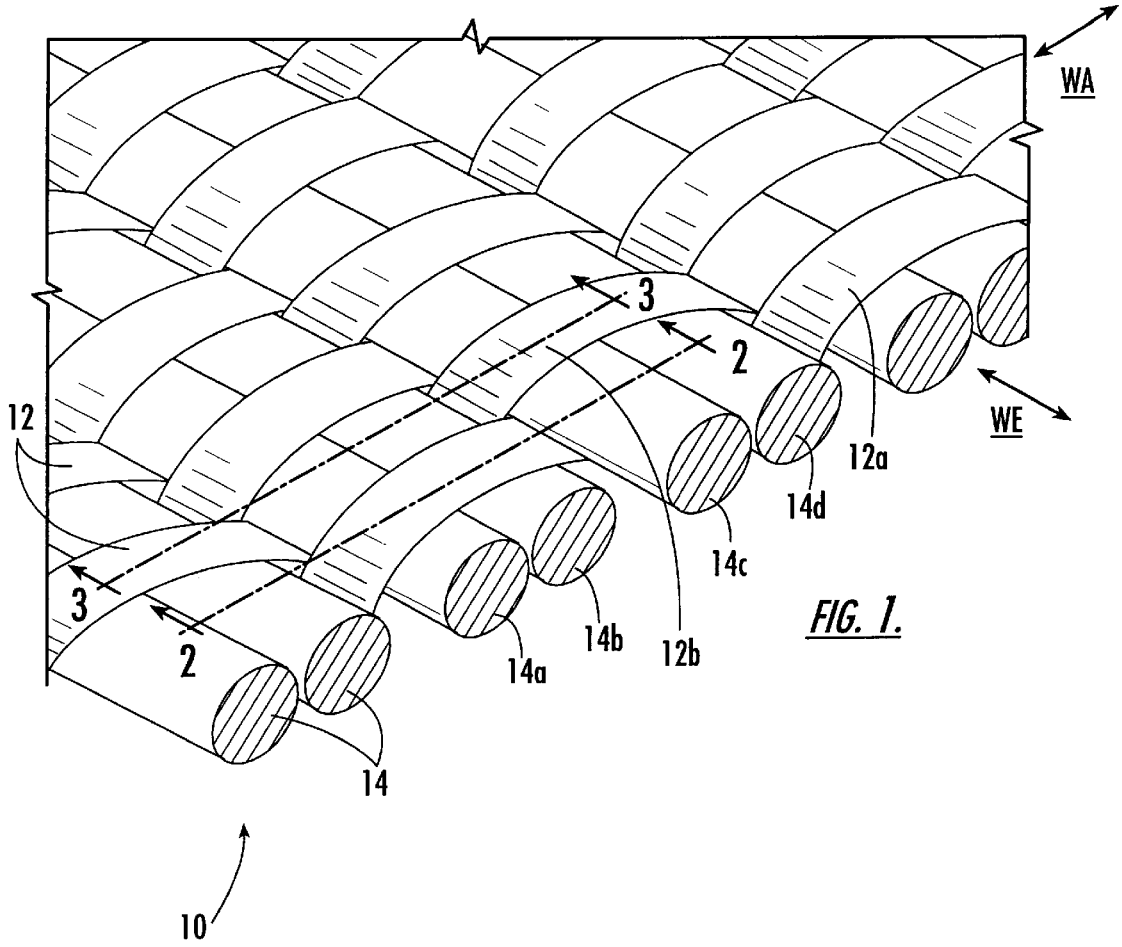
FIG. 1 is an enlarged perspective view of a portion of a fabric of the present invention.
Figure 2:
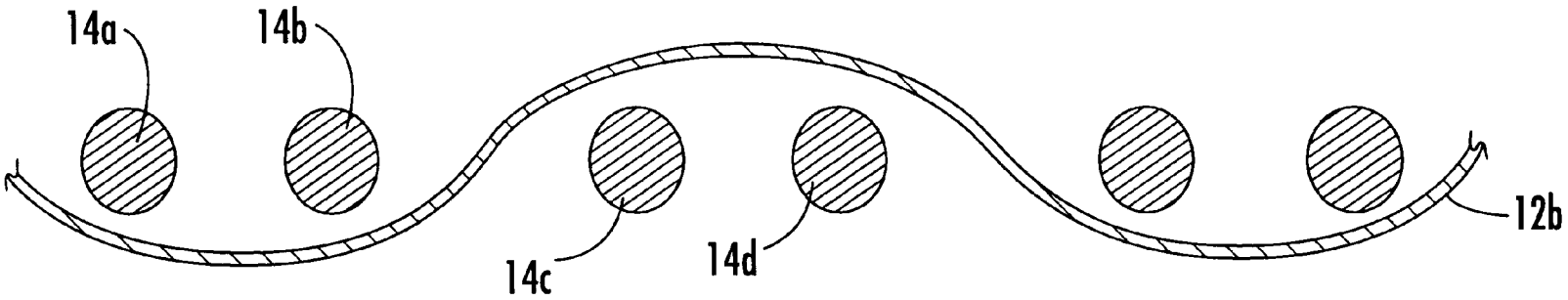
FIG. 2 is a section view of the fabric of FIG. 1 taken along lines 2—2 of FIG. 1.
Figure 3:
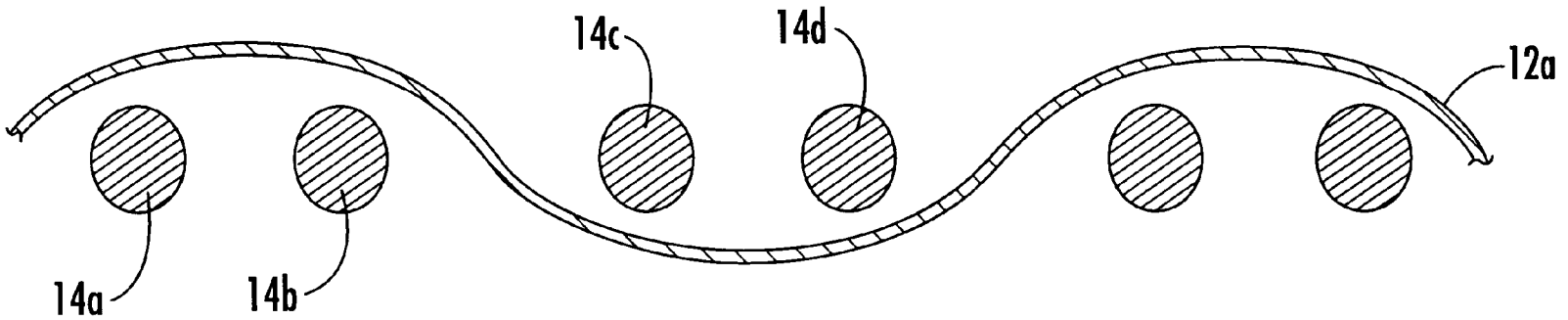
FIG. 3 is a section view of the fabric of FIG. 1 taken along lines 3—3 of FIG. 1.

Referring now to the drawings, a fabric, designated broadly at 10, is illustrated in FIGS. 1–3. The fabric 10 includes a plurality of flat film warp yarns 12 extending in a warp direction (designated in FIG. 1 at WA), and further includes a plurality of weft yarns 14 extending in a weft direction (designated in FIG. 1 at WE) that is generally perpendicular to the warp direction. As can be seen in FIG. 1, the weft yarns 14 are interwoven with the flat film warp yarns 12 to form the fabric 10.

The flat film warp yarns 12 are formed of a flat polymeric thin film. The width of each flat film warp yarn 12 is typically between about 0.025 and 0.010 inches, with a width of between about 0.020 and 0.014 inches being preferred. The thickness of each flat film warp yarn 12 is between about 20 and 40 $\mu$m, with a thickness of between about 25 and 30 $\mu$m being preferred.

As stated, the flat film warp yarns 12 are formed of a polymeric material. Exemplary polymeric materials include polyester, polyethylene, nylon, and blends thereof, with a blend of polyester and polyethylene being preferred. More preferably, the flat film warp yarns 12 are formed of a polyester/polyethylene blend comprising between about 70 to 90 percent polyester and between about 30 to 10 percent polyethylene by weight. These yarns are typically formed of a transparent or translucent polymeric material. Also, the material may include a gloss reducing agent, such as $TiO_2$, as well as other fillers.

The film from which the flat film warp yarns 12 are formed can be made by virtually any method of film forming known to those skilled in this art. In the illustrated embodiment, the film is formed by an extrusion process that causes the polymer chains in the film to be generally aligned in the direction of extrusion. This alignment can add strength to the film in the direction of extrusion, which corresponds to the length dimension of the flat film warp yarns. Alternatively, the film may be formed through a blowing process known to those skilled in this art.

The weft yarns 14 can comprise natural yarns, such as cotton or wool, or synthetic yarns, such as polyester, rayon, nylon, and polypropylene, and blends thereof. The weft yarns 14 may be, for example, monofilament or multifilament yarns, and may be spun, cabled, or twisted, or of any other form known to those skilled in this art to be suitable for textile fabrics. Such yarns, preferably, have a "cotton count" (i.e., the measure of the weight in pounds of 840 yards of the yarn) of 4/1 to 47/1. In keeping with convention for bedding and upholstery, the weft yarns 14 are preferably spun from staple fiber (as opposed to continuous filament yarns.)

As can be seen from FIGS. 1–3, the flat film warp yarns 12 and weft yarns 14 are preferably interwoven in a "double pick" weave, in which each flat film warp yarn 12 passes over a pair of coupled weft yarns 14 (exemplified by weft yarns 14*a*, 14*b*), then passes under the next adjacent pair of coupled weft yarns 14 (exemplified by weft yarns 14*c*, 14*d*). Adjacent flat film warp yarns 12 alternatively pass over and under adjacent coupled pairs of weft yarns 14; for example, the flat film weft yarn 12*a* passes over the weft yarns 14*a*, 14*b* and under the weft yarns 14*c*, 14*d*, while the adjacent flat film warp yarn 12*b* passes under the weft yarns 14*a*, 14*b* and over the weft yarns 14*c*, 14*d*. Preferably, the fabric 10 is interwoven such that between about forty to seventy flat film warp yarns 12 and approximately 50 to 120 weft yarns 14 are present per square inch of fabric. More preferably, between about fifty and sixty flat film warp yarns 12 and sixty to eighty weft yarns 14 are present per square inch of fabric.

Those skilled in this art will recognize that, although a double picked weave pattern is preferred for some embodiments, single picked weave patterns may also be used. Also, although the double picked yarns are illustrated herein as a plain weave, other weave patterns, such as twills, satins and sateens, may be employed with the present invention.

Notably, the inclusion of the flat film warp yarns 12 can reduce the number of total yarns present per square inch of fabric while maintaining an acceptable texture and fabric appearance. For example, if a flat film warp yarn 12 formed of 80 percent polyester and 20 percent polyethylene and having a width of 0.020 inches and a thickness of 25 $\mu$m is employed, such a flat film yarn is approximately 3.5 times greater in width than a spun yarn of equal weight. As a result, fewer warp yarns can be included than for a typical fabric to provide the same "coverage" and barrier (light and batting) properties within the plane of the fabric. However, some additional weft yarns may be desired to increase the weight, (and, in turn, the quality) of the fabric. The economic trade-off is positive; the cost of adding of a few more weft yarns can be more than an offset by the warp yarn cost savings. Typically, the inclusion of additional weft yarns raises the cost of manufacturing a fabric because of the additional loom motions needed for the extra weft yarns; however, for the illustrated "double-picked" weave, the number of loom motions is only half that of the number of yarns, as two weft yarns are inserted simultaneously into the warp shed.

In many fabrics, the use of a double-picked weaving pattern provides an unsatisfactory appearance to a fabric, as coupled adjacent weft yarns tend to "pair" with each other; this pairing can create wide spacing between coupled weft yarn pairs and cause a striated appearance. In contrast, in the fabric of the present invention, the width of the flat film warp yarns 12 tends to match that of the paired weft yearns 14 and thus lends a more balanced (i.e., less striated) look to the fabric 10. Also, the coverage provided by the flat film warp yarns 12 causes them to reflect more light than conventional yarns, which also tends to mask the pairing of the weft yarns 14. Thus, the resulting fabric 10 can have an acceptable appearance and feel at a reduced cost. It may be advantageous to subject the fabric 10 to a surface treatment, such as calendering or sanforizing, as doing so may soften rough edges of the flat film warp yarns 12.

In addition, the flat film warp yarns 12 can also impart a "chintzed" look to the fabric (ie., the fabric has the appearance of polished cotton). Because the flat film warp yarns 12 are formed of a polymeric film, the chintzed appearance may be less prone to fading or otherwise subsiding (i.e. may be more "permanent") than that of prior fabrics.

Figure 4:
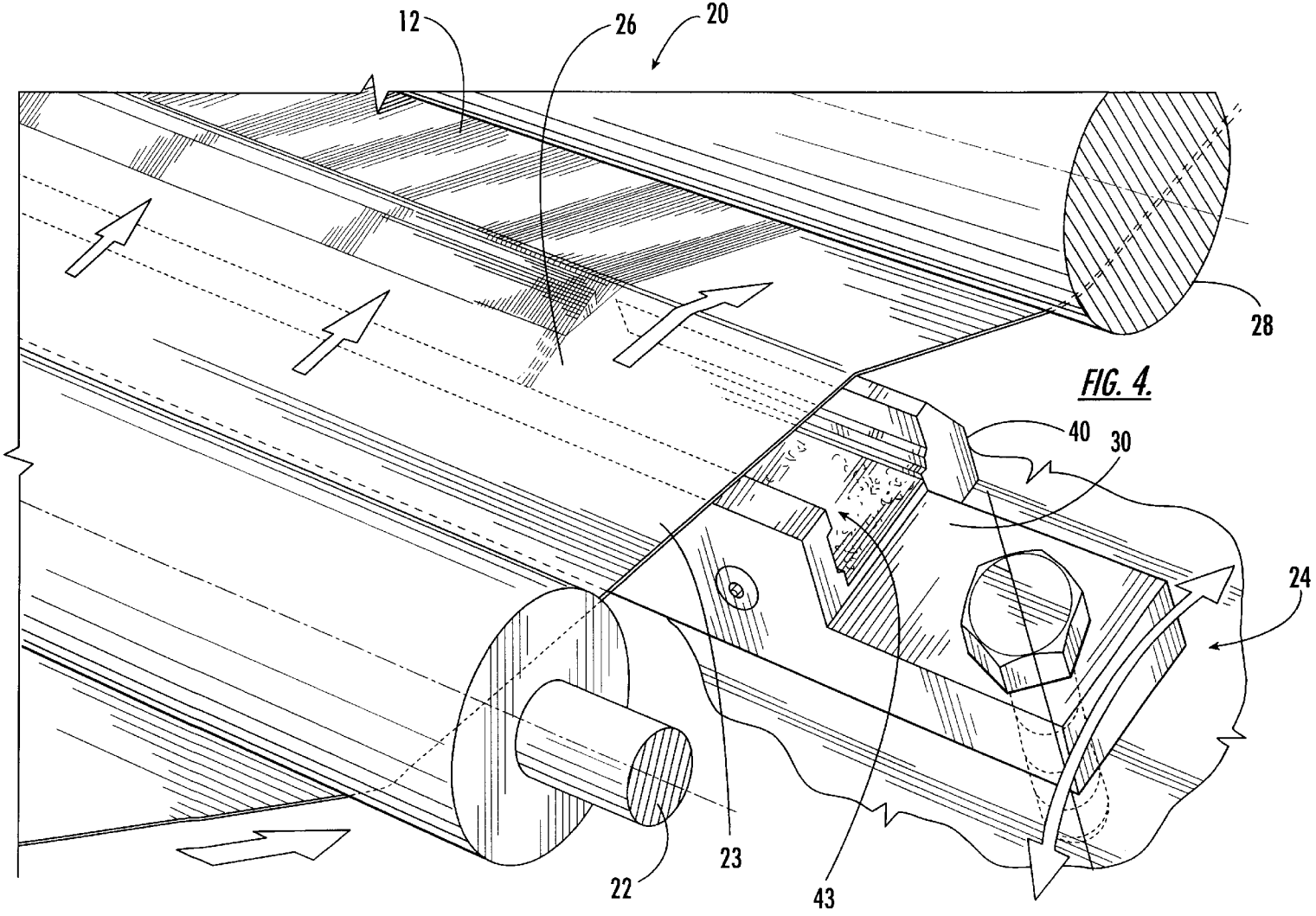
FIG. 4 is a partial perspective view of an apparatus for slitting thin film into yarns according to the present invention.

The flat film warp yarns 12 of the fabric 10 can be formed from a wider sheet of film in a one-step slitting process. The slitting process can be carried out with a slitting apparatus such as that designated at 20 in FIG. 4. The slitting apparatus 20 comprises a feed roll 22 over which a thin polymeric film 23 is wrapped, a blade cartridge frame 24 that houses a blade cartridge 26, and a loon beam 28. As can be seen in FIG. 4, the film 23 is unrolled from the feed roll 22 and passes over the blade cartridge 26, which cuts the film 23 into a plurality of flat film warp yarns 12 that are received on the loom beam 28. From the loom beam 28, the flat film warp yarns 12 can be fed into a loom for weaving with weft yarns 14.

Figure 5:
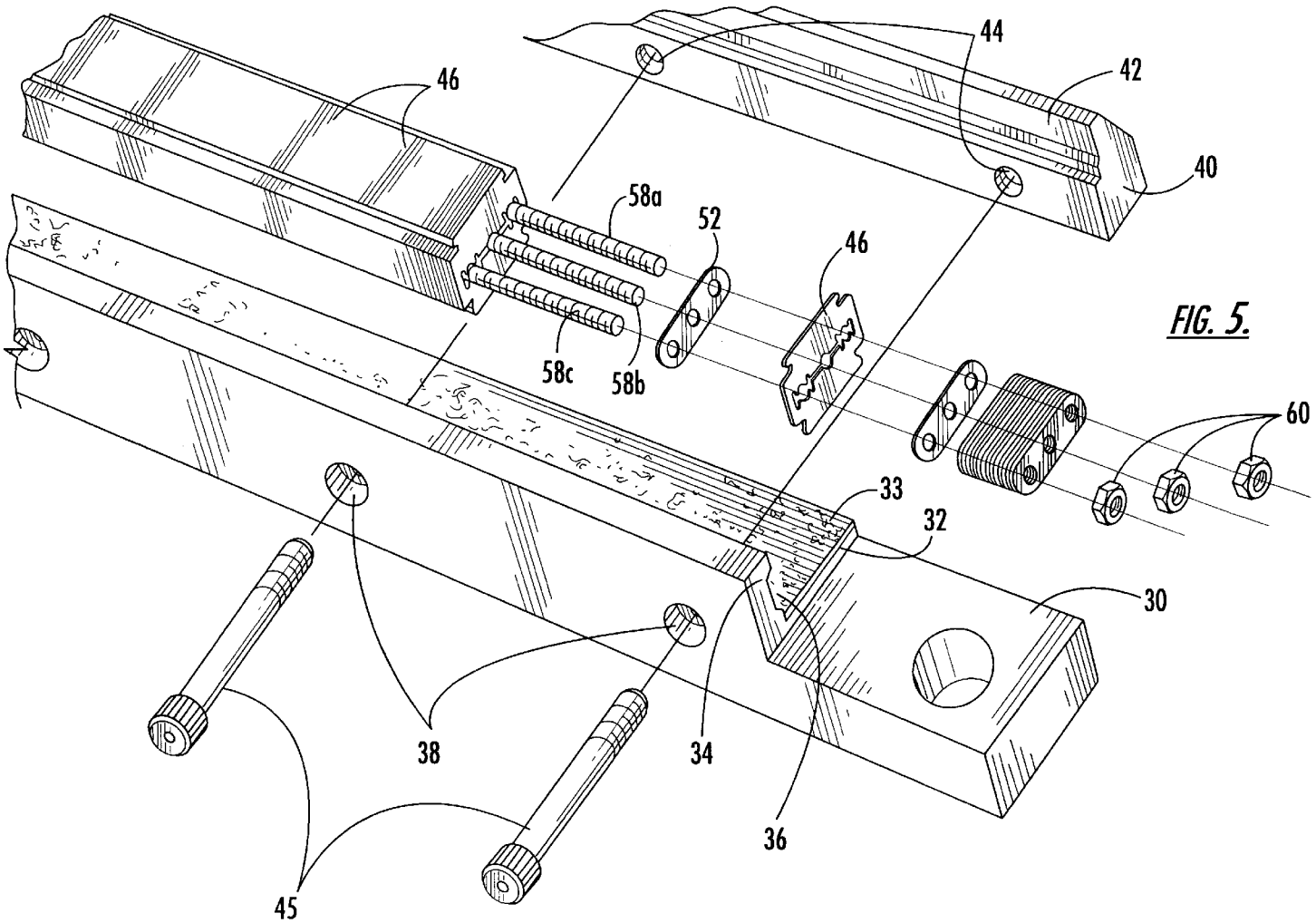
FIG. 5 is an exploded view of the cutting blade cartridge, mounting block and clamping block of the apparatus of FIG. 4.

FIG. 5 illustrates the interrelationship of the components of the slitting apparatus 20, including a frame block 30, a clamping block 40, and the blade cartridge 26. The frame block 30 includes a floor 32 which is covered by a protective elastomeric pad 33, and further includes an upright panel 34 that extends upwardly from the front edge of the floor 32. The clamping block 40 is positioned on the opposite side of the frame block 30 from the upright panel 34. Thus, the floor 32, upright panel 34, and clamping block 40 define a blade cartridge compartment 43. The upright panel 34 includes a recess 36 that faces the clamping block 40; likewise, the clamping block 40 includes a recess 42 that faces the upright panel 34. The upright panel 34 and clamping block 40 include, respectively, apertures 38, 44 that receive bolts 45 for tightening the clamping block 40 into place. Of course, those skilled in this art will recognize that other means for receiving and retaining the blade cartridge 26 may also be employed with the present invention.

The blade cartridge 26 includes a plurality of blades 46, each of which is held in spaced apart relation from adjacent blades 46 with spacers 52. Each blade 46 (typically about 0.004 inches in thickness) has a pair of cutting edges 48*a*, 48*b* along its longer sides and end projections 47*a*, 47*b* extending away from either end, such that two planes of symmetry are present: one bisecting the cutting blade 46 lengthwise; and the other bisecting the cutting blade 46 widthwise. Each blade 46 also includes an internal cutout area 50.

Each spacer 52 is somewhat oblong, with parallel opposed edges 53 and rounded ends 54, and includes three interior apertures 56. Like the cutting blades 46, each spacer 52 has two planes of symmetry bisecting the spacer 52 lengthwise and widthwise perpendicular to the plane of the spacer 52. Illustratively and preferably, the spacers 52 are between about 0.010 and 0.040 inches in thickness such that the cutting edges 48*a*, 48*b* of the blades 46 are spaced about 0.020 to 0.050 inches apart. Together, the spacers 52 and blades 46 can be sufficiently numerous that, when assembled, the cartridge 26 can be of virtually any length, including up to and beyond 120 inches as needed.

The blades 46 and spacers 52 are mounted on mounting rods 58*a*, 58*b*, 58*c*, each of which extends through the apertures 56 of the spacers 52 and the cutout portions 50 of the blades 46. Once mounted with the spacers 52, the cutting blades 46 are in substantially parallel, substantially aligned, spaced apart relationship. As used herein, "substantially aligned" means that the perimeter of each blade 46 is substantially aligned with the perimeters of adjacent blades in the direction normal to the plane of the blade 46. The mounting rods 58*a*, 58*b*, 58*c* are held in place with nuts 60 attached at each end thereof. Of course, those skilled in this art will recognize that other mounting structures for the cutting blades, such as a mounting block with slots to receive the blades, may also be used with the present invention.

Figure 6:
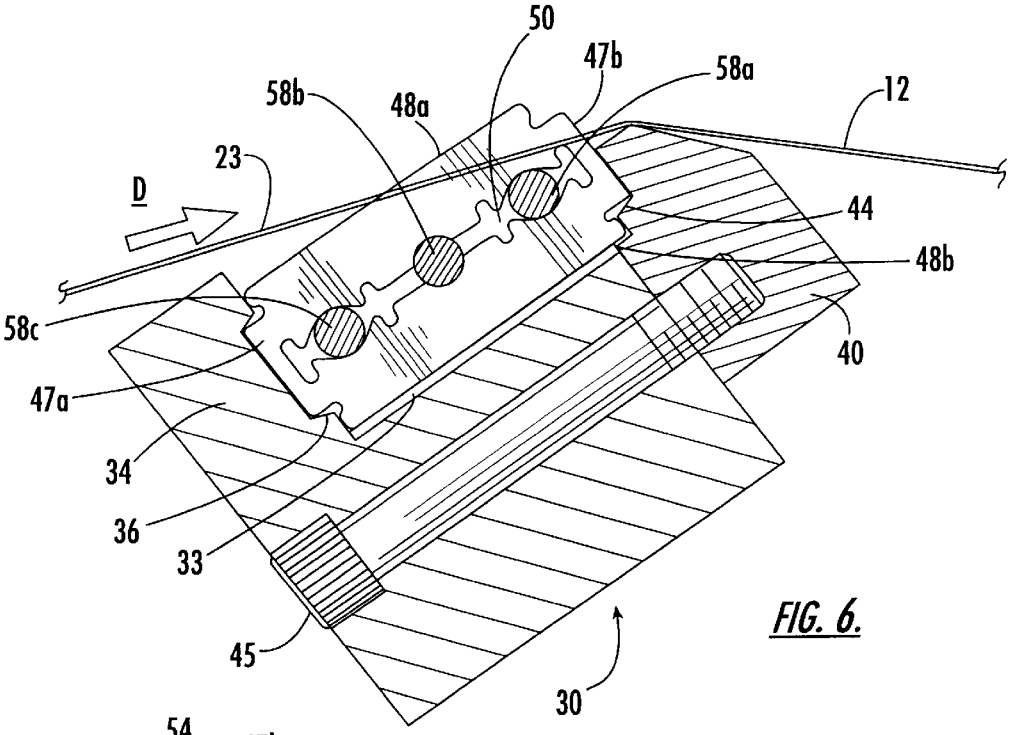
FIG. 6 is an enlarged section view of the assembled blade cartridge, mounting block and clamping block of FIG. 5.
Figure 7:
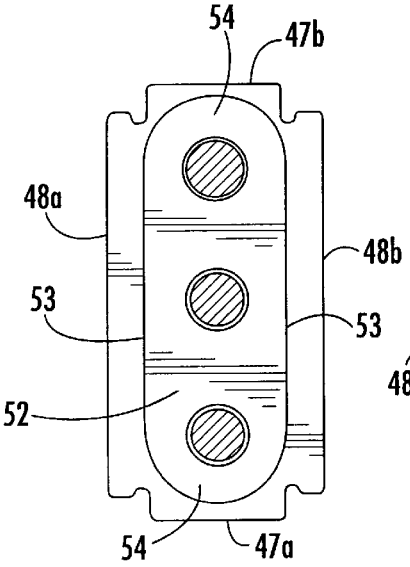
FIG. 7 is a section view of a blade and spacer of a blade cartridge of FIG. 6.

Once construction of the blade cartridge 26 has been completed by mounting the blades 46 and spacers 52 on the mounting rods 58*a*, 58*b*, 58*c*, the blade cartridge 26 is secured in place in the blade cartridge frame 24. This is completed by positioning the blade cartridge 26 therein such that end projections 47*a* of the blades 46 extend within the recess 36 of the upright panel 34, and the end projections 47*b* of the blades 46 extend within the recess 42 of the clamping block 40. The cutting edges 48*b* of the blades 46 rest upon the pad 33. The clamping block 40 is then secured to the frame block 30 through tightening of the bolts 45. In this configuration, the cutting edges 48*a* are exposed and therefore able to cut film 23 into flat film warp yarns 12 as it passes over the blades 46 (see FIG. 6) in a general downstream direction D; the width of the flat film yarns 12 is dependent on the distance between cutting edges 48*a* of adjacent blades 46.

Figure 9:
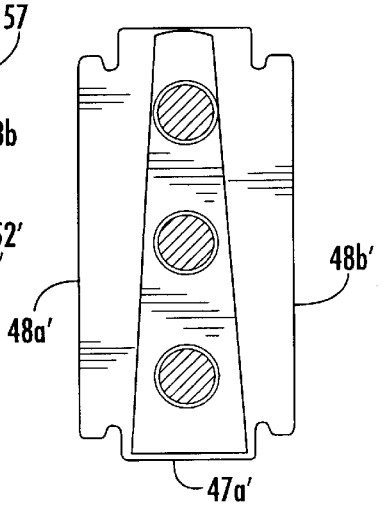
FIG. 9 is a prior art cutting blade and spacer configuration.

Notably, each spacer 52 is configured such that its edges 53 and ends 54 are recessed from the cutting edges 48*a*, 48*b* and end projections 47*a*, 47*b* such that either cutting edge 48*a*, 48*b* of each blade 46 can be completely exposed when the blade cartridge 26 is mounted in the blade cartridge compartment 43. As a result, the film 23 can be cut without interference from the spacers 52 irrespective of the orientation of the blade 46 within the blade cartridge 26. Also, the rounded ends 54 provide a smooth, nondamaging surface for the film to slide upon after slitting. Therefore, either cutting edge 48*a*, 48*b* can be used to cut the film 23, and can be used irrespective of which blade end 47*a*, 47*b* is positioned within the recess 36. Consequently, the blades 46 can be used twice as long as a prior art spacer illustrated in FIG. 9, in which the portions of the cutting edges 48*a*', 48*b*' near the end 47*a*' cannot be used.

Figure 8:
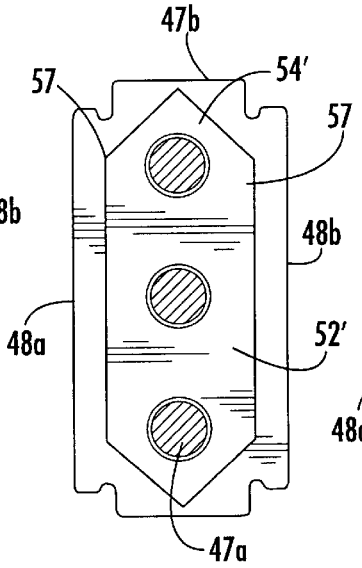
FIG. 8 is an alternative embodiment of a blade and spacer arrangement.
Figure 10:
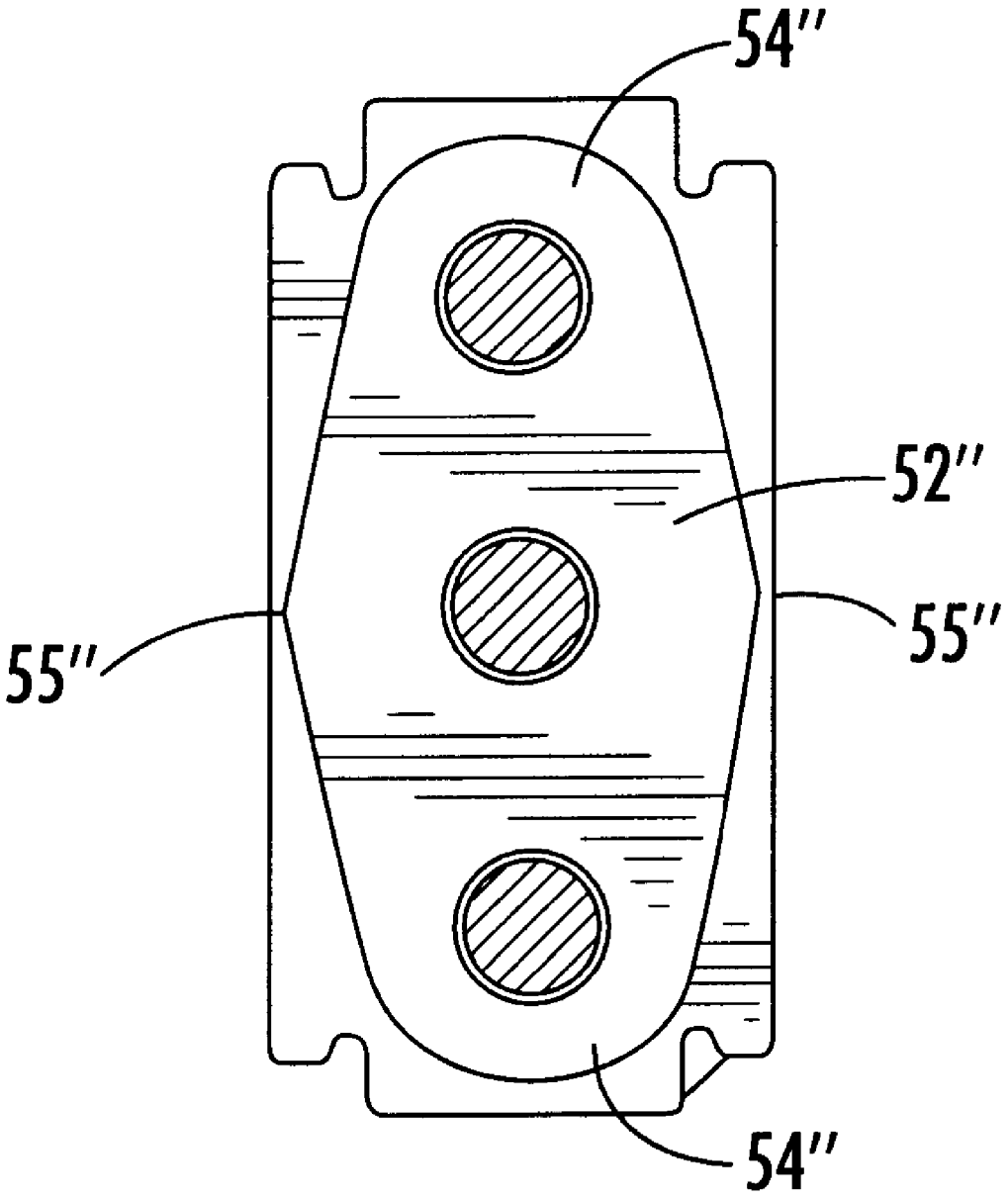
FIG. 10 is another alternative embodiment of a blade and spacer arrangement.

Importantly, the spacers 52 are of sufficient size to support the cutting edges 48*a*, 48*b* without undue deflection during slitting. The same is true for additional spacer embodiments illustrated in FIG. 8 and 10. In FIG. 8, the spacer, designated at 52', is a truncated diamond shape, with the wedge-shaped end 54' being recessed such that the spacer 52' fails to interfere with the film 23 as it is cut, but being configured to support the cutting edges of the attached blade. The comers 57 of the spacer 52' are preferably rounded somewhat to provide a proper sliding surface for the film after slitting. In FIG. 10, the spacer 52" is a diamond shape with rounded ends 54" and comers 55".

Those skilled in this art will appreciate that the slitting apparatus 20 of the present invention can be modified such that it is connected with and provides flat film warp yarns directly to the weaving process. In such a configuration, the blade cartridge 26 would be mounted onto one end of a loom, and the flat film warp yarns 12, after being slit by the blades 46, would be fed directly into a fabric during weaving.

As can be seen by the foregoing, the slitting apparatus 20 can be used to produce flat film weft yarns 12 for the fabric 10 in a simple, inexpensive operation. As such, flat film warp yarns 12 can be produced at a far lower cost than spun yarns of corresponding size and weight. As a result, the fabric 10 can be produced considerably less expensively than a corresponding fabric employing spun yarns in place of the flat film warp yarns 12.

The invention will now be described in greater detail in the following non-limiting example.

EXAMPLE

A textile fabric was constructed from slit film warp yarns interwoven with spun weft yarns. The warp yarns were cut from a polymer film 25 $\mu$m thick formed of a blend of 80% polyester/20% polyethylene. Slitting was performed at a feed rate of 35 yards/minute on a slitting apparatus such as that illustrated in FIGS. 4 through 7, with the cutting blades mounted 0.020 inches apart. The warp yarns were then interwoven in a "double pick" weave pattern with weft yarns formed of 37/1 spun blend of 50% polyester and 50% cotton. After weaving, the fabric was calendered at a speed of 30 yards/minute at room temperature. The finished fabric was observed to have an acceptable appearance and feel.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

That which is claimed is:

1. A textile fabric, comprising:

a plurality of weft yarns extending generally in a weft direction; and a plurality of individual flat film warp yarns extending generally in a warp direction, said warp yarns being interwoven individually with said weft yarns in a series of identical repeating units of a predetermined weave pattern, each of said individual flat film warp yarns having a width of between about 0.010 and 0.025 inches.

2. The textile fabric defined in claim 1, wherein, in each of said identical repeating units of said predetermined weave pattern, said weft yarns are interwoven with said flat film warp yarns as coupled pairs, such that a first yarn of each of said coupled pairs follows the same interweaving pattern relative to each of said flat film warp yarns as a second yarn of that pair.

3. The textile fabric defined in claim 1, wherein, in each of said repeating units, each flat film warp yarn travels over one coupled pair of weft yarns and under one coupled pair of weft yarns, with adjacent flat film warp yarns traveling under alternate pairs of weft yarns and over alternate pairs of weft yarns.

4. The textile fabric defined in claim 1, wherein said flat film warp yarns are formed of a material selected from the group consisting of: polyester; polyethylene; and blends thereof.

5. The textile fabric defined in claim 1, wherein said flat film warp yarns are formed of a blend of polyester and polyethylene.

6. The textile fabric defined in claim 1, wherein said flat film warp yarns have a thickness of between about 10 and 40 $\mu$m.

7. The textile fabric defined in claim 1, wherein said weft yarns and said flat film warp yarns are sized and interwoven such that between about 40 and 70 flat film warp yarns and between about 50 and 120 weft yarns are present per square inch of fabric.

8. A textile fabric, comprising:

a plurality of weft yarns extending generally in a weft direction; and a plurality of flat film warp yarns extending generally in a warp direction, said warp yarns being interwoven with said weft yarns in a series of identical repeating units of a predetermined weave pattern, wherein, in each of said identical repeating units, said weft yarns are interwoven with said flat film warp yarns as coupled pairs, such that a first yarn of each of said coupled pairs follows the same interweaving pattern relative to each of said flat film warp yarns as a second yarn of that pair.

9. The textile fabric defined in claim 8, wherein, in each of said repeating units, each flat film warp yarn travels over one coupled pair of weft yarns and under one coupled pair of weft yarns, with adjacent flat film warp yarns traveling under alternate pairs of weft yarns and over alternate pairs of weft yarns.

10. The textile fabric defined in claim 8, wherein said flat film warp yarns are formed of a material selected from the group consisting of: polyester; polyethylene; and blends thereof.

11. The textile fabric defined in claim 8, wherein said flat film warp yarns are formed of a blend of polyester and polyethylene.

12. The textile fabric defined in claim 8, wherein said flat film warp yarns have a thickness of between about 10 and 40 $\mu$m.

13. The textile fabric defined in claim 8, wherein said weft yarns have a cotton count of between about 4/1 and 47/1.

14. The textile fabric defined in claim 8, wherein said weft yarns and said flat film warp yarns are sized and interwoven such that between about 40 and 70 flat film warp yarns and between about 50 and 90 weft yarns are present per square inch of fabric.

15. A textile fabric, comprising:

a plurality of weft yarns extending generally in a weft direction; and a plurality of flat film warp yarns extending generally in a warp direction, said warp yarns being interwoven with said weft yarns in a series of identical repeating units of a predetermined weave pattern, each of said flat film warp yarns having a width of between about 0.010 and 0.025 inches.;

wherein said weft yarns have a cotton count of between about 4/1 and 47/1.

16. The textile fabric defined in claim 15, wherein, in each of said identical repeating units of said predetermined weave pattern, said weft yarns are interwoven with said flat film warp yarns as coupled pairs, such that a first yarn of each of said coupled pairs follows the same interweaving pattern relative to each of said flat film warp yarns as a second yarn of that pair.

17. The textile fabric defined in claim 15, wherein, in each of said repeating units, each flat film warp yarn travels over one coupled pair of weft yarns and under one coupled pair of weft yarns, with adjacent flat film warp yarns traveling under alternate pairs of weft yarns and over alternate pairs of weft yarns.

18. The textile fabric defined in claim 15, wherein said flat film warp yarns are formed of a material selected from the group consisting of: polyester; polyethylene; and blends thereof.

19. The textile fabric defined in claim 15, wherein said flat film warp yarns are formed of a blend of polyethylene.

20. The textile fabric defined in claim 15, wherein said flat film warp yarns have a thickness of between about 10 and 40 $\mu$m.

21. The textile fabric defined in claim 15, wherein said weft yarns and said flat film warp yarns are sized and interwoven such that between about 40 and 70 flat film warp yarns and between about 50 and 120 weft yarns are present per square inch of fabric.

* * * * *